US005168818A

United States Patent [19]

Joffrion

[11] Patent Number: 5,168,818

[45] Date of Patent: Dec. 8, 1992

[54] LIQUID COOLED BOILER DOOR

[76] Inventor: Eric J. Joffrion, 4102 Potomac, Abilene, Tex. 79605

[21] Appl. No.: 665,817

[22] Filed: Mar. 7, 1991

[51] Int. Cl.[5] ..... F23M 5/08; F23M 7/04

[52] U.S. Cl. ..... 110/180; 122/498

[58] Field of Search ..... 122/498; 110/180; 432/237, 250

[56] References Cited

U.S. PATENT DOCUMENTS

| | | | |
|---|---|---|---|
| 725,746 | 4/1903 | Moore . | |
| 725,747 | 4/1903 | Moore . | |
| 1,103,297 | 7/1914 | Knox | 122/498 |
| 2,513,626 | 7/1950 | Corriston | 122/498 |
| 2,673,533 | 3/1954 | Robinson | 110/173 |
| 3,155,080 | 11/1964 | Braun | 122/498 |
| 3,156,218 | 11/1964 | Braun | 122/498 |
| 3,198,178 | 8/1965 | Reighart | 122/498 |
| 3,212,478 | 10/1965 | Braun | 122/498 |
| 3,214,154 | 10/1965 | Olsson | 263/46 |
| 3,252,448 | 5/1966 | Braun | 122/498 |
| 3,477,411 | 11/1969 | Gething | 122/7 |
| 3,705,717 | 12/1972 | Hadberg | 266/24 |
| 4,570,550 | 2/1986 | Wilt | 110/180 |
| 4,783,790 | 11/1988 | Valchev et al. | 373/108 |

*Primary Examiner*—Henry C. Yuen

*Attorney, Agent, or Firm*—Richards, Medlock & Andrews

[57] ABSTRACT

A liquid-cooled boiler door for use with a boiler having a flooded liquid section and a storage liquid section. The liquid-cooled boiler door includes an interior wall having an interior surface and an exterior surface and an exterior wall having an interior surface and an exterior surface. The exterior wall is spaced from said interior wall to define a circulation space therebetween. A first connector fluidly connects the flooded liquid section of the boiler to the circulation space defined between the interior wall and the exterior wall of the liquid-cooled boiler door. A second connector fluidly connects the storage liquid section of the boiler to the circulation space defined between the interior wall and the exterior wall. Liquid contained within the boiler circulates from the flooded liquid section, through the circulation space defined between the interior wall and the exterior wall, and into the storage section of the boiler.

10 Claims, 3 Drawing Sheets

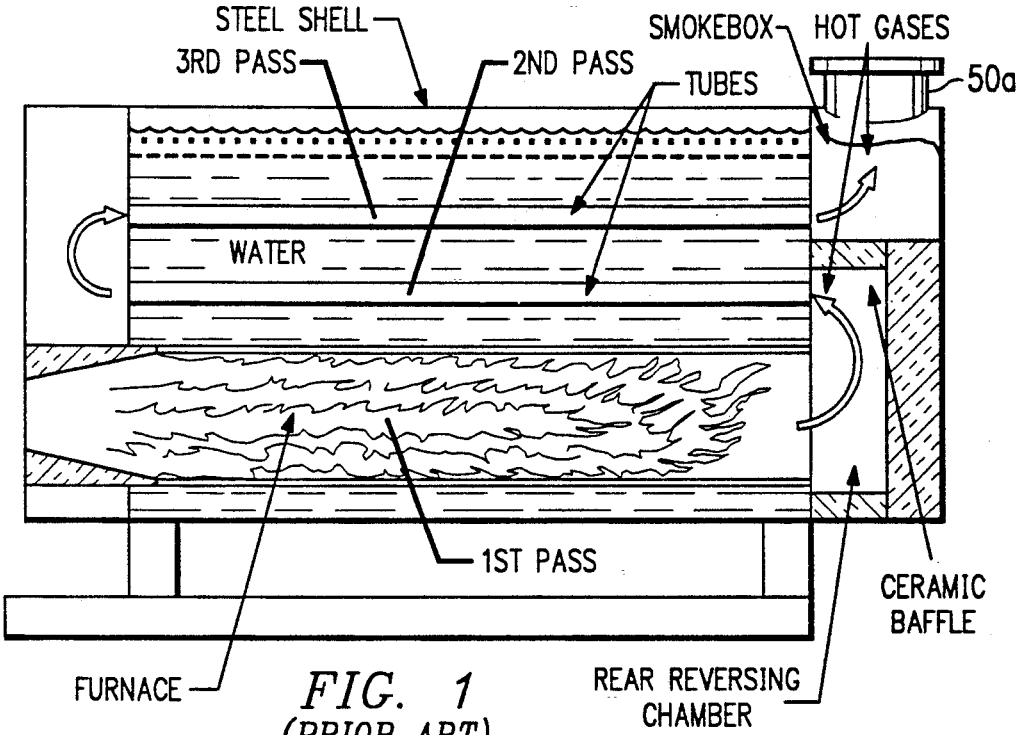
FIG. 1
(PRIOR ART)
FIG. 2
(PRIOR ART)
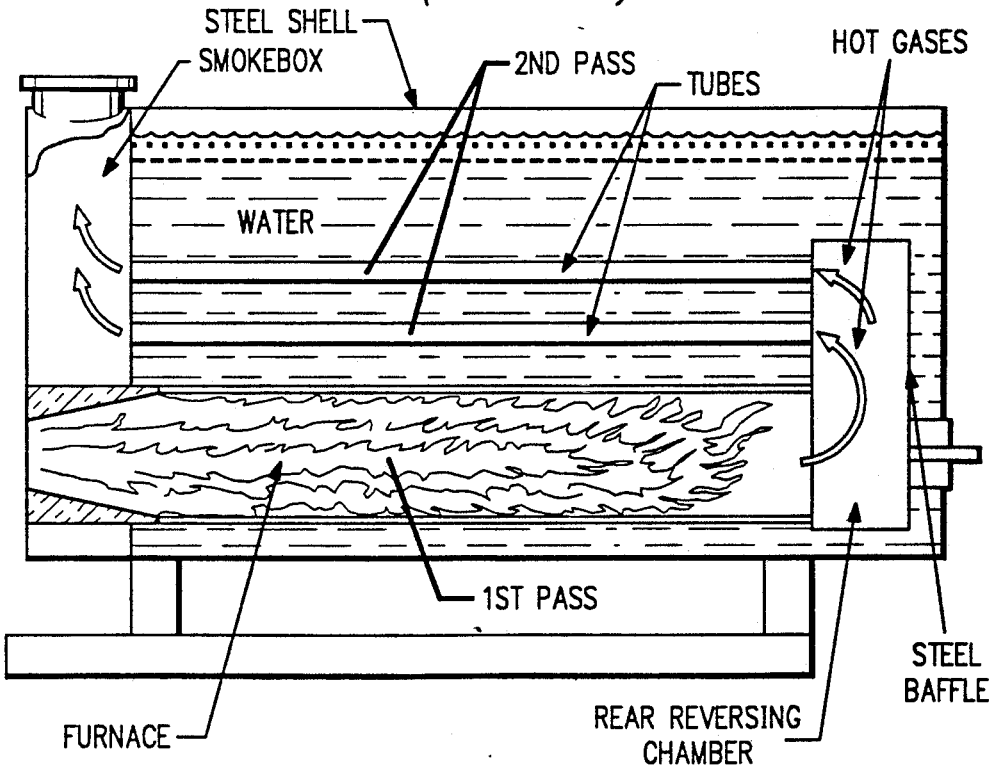

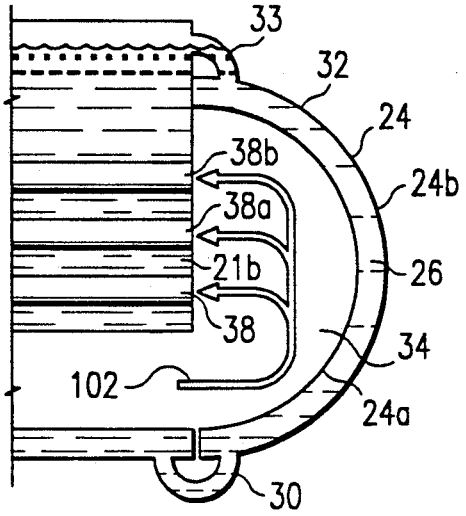
FIG. 6
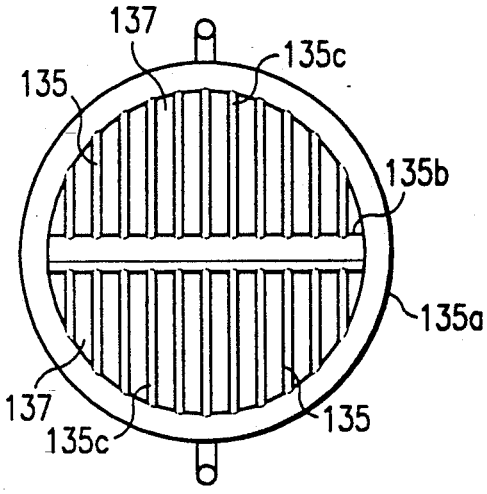
FIG. 7
FIG. 8
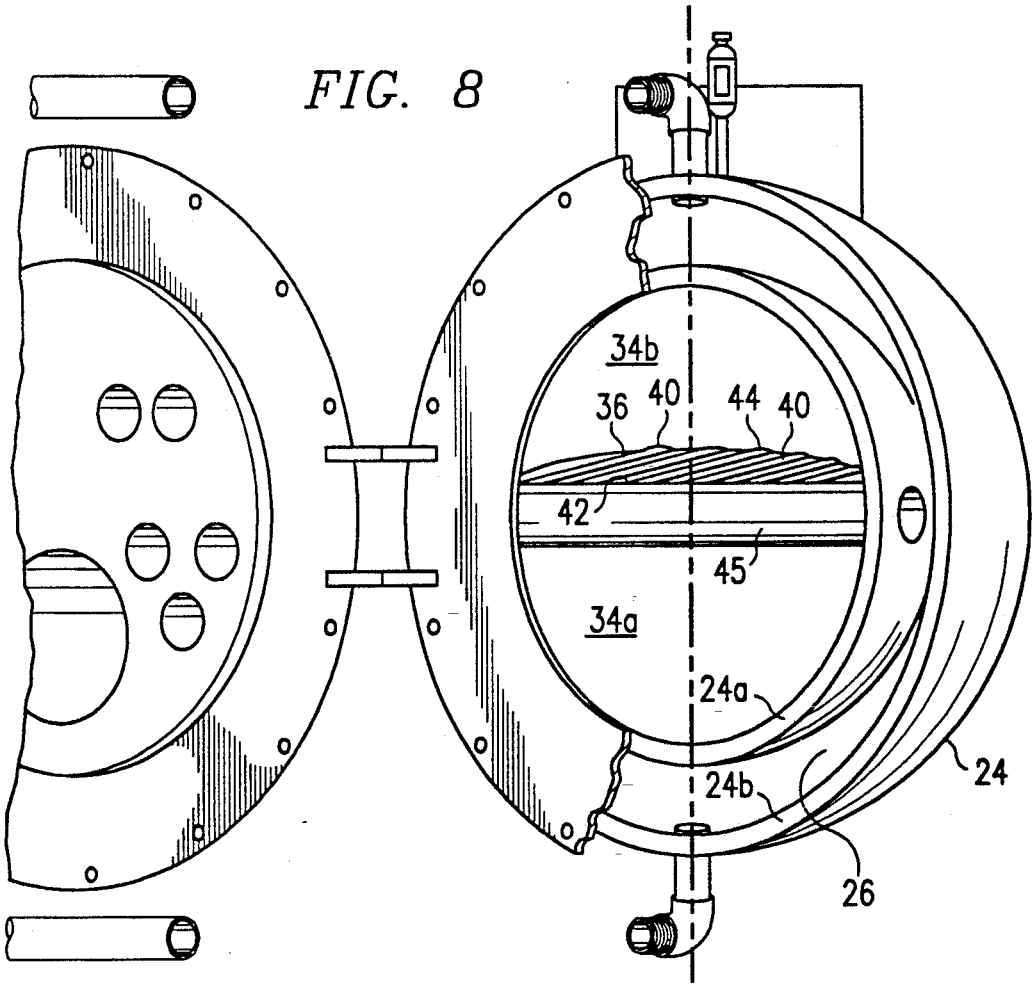

LIQUID COOLED BOILER DOOR

TECHNICAL FIELD OF THE INVENTION

The present invention relates to a door for use in conjunction with a firetube boiler. In particular, the invention relates to a firetube boiler door which is cooled by internal liquid circulation.

BACKGROUND OF THE INVENTION

Firetube boilers are commonly used to heat water for a variety of purposes. Firetube boilers typically are formed by a cylindrical vessel capped at each end. A plurality of parallel or substantially parallel heating tubes are disposed within the vessel. A main furnace tube is also defined within the vessel. A stream of high temperature gases is directed down the furnace tube from a main flame source. Upon reaching the opposite end of the vessel, i.e., the turnaround chamber, the heated gases are reflected through the parallel heating tubes of the firetube boiler. The number of times that these heated gases are reflected defines the number of "passes" employed by the boiler. Thus, if the stream of heated gases is reflected once, the boiler is considered to be a two-pass boiler. If the stream of heated gases is reflected twice, the boiler is considered to be a three-pass boiler.

In order to effect the desired magnitude of heating of the liquid within the boiler, very high levels of heat are directed through the furnace tube and the heating tubes of the boiler. As a result, it has been found that the internal surfaces of the turnaround chamber, in particular the rear wall of the turnaround chamber, are subjected to great erosion from the heated gases. In order to minimize the detrimental effects of the heated gases on the turnaround chamber, two alternative approaches have been developed.

Some boilers employ a ceramic refractory lining within the turnaround chamber in order to minimize erosion. Such boilers are sometimes referred to as "dryback" boilers. Boilers employing such a refractory lining have proven to be somewhat successful in reducing erosion of the turnaround chamber.

In some dryback boilers, the refractory-lined wall of the turnaround chamber is a door which permits access to the interior of the boiler, thereby facilitating service of the interior of the boiler. It has been found, however, that there is a significant level of heat loss realized through the ceramic refractory material due to its relatively poor insulating characteristics. In addition, the ceramic refractory material is also subject to the erosive effects of the hot gases over extended periods of use, thereby requiring replacement or repair of the door.

An alternative approach to resolving the erosion problems has given rise to what is known as a "wetback boiler." Rather than employing a refractory material to limit erosion of the turnaround chamber, the wetback boiler utilizes a body of water contained within the boiler to cool the walls of the turnaround chamber. The body of water "surrounds" the turnaround chamber on three sides, and thus essentially "submerges" the turnaround chamber. The presence of water around the turnaround chamber provides greater insulation than the refractory material discussed above, thereby minimizing heat loss from the boiler.

Although providing better resistance to erosion and better insulation characteristics as compared to the "dryback" firetube boiler, there are certain disadvantages associated with the wetback boiler. The wetback design often significantly reduces access to the interior of the boiler through the rear wall of the turnaround chamber. Although most wetback boilers include a small porthole through the cooling chamber, these portholes are typically very small in dimension, thereby reducing access to the interior of the boiler. Thus, it has been found to be considerably more difficult to service the interior of a wetback boiler as compared to dryback boilers having a larger access door disposed at the rear wall of the turnaround chamber.

SUMMARY OF THE INVENTION

The liquid-cooled boiler door of the present invention includes an interior wall and an exterior wall which define a water circulation space therebetween. The circulation space of the boiler door is fluidly connected at one end to a flooded section of the boiler. The circulation space of the boiler door of the present invention is also fluidly connected at a second end to a storage section of the boiler such that water circulates naturally from the flooded section of the boiler, through the circulation space of the liquid-cooled boiler door, and into the storage section of the boiler.

In an alternative embodiment of the present invention, a liquid-cooled baffle is formed on the interior wall of the liquid-cooled door. The liquid-cooled baffle includes plurality of substantially parallel liquid tubes fluidly connected to the circulation space of the liquid-cooled boiler door.

BRIEF DESCRIPTION OF THE DRAWINGS

For a more complete understanding of the present invention, and for further details and advantages thereof, reference is now made to the following Detailed Description read in conjunction with the accompanying drawings in which:

FIG. 1 is a cross-sectional view of a known three-pass "dryback" firetube boiler;

FIG. 2 is a cross-sectional view of a known two-pass "wetback" firetube boiler;

FIG. 6 is a detailed view of an alternative embodiment of the liquid-cooled boiler door of the present invention;

FIG. 7 is a detailed view of a boiler door constructed in accordance with one embodiment of the present invention in use with a firetube boiler; and FIG. 8 is a perspective view of the interior of a liquid-cooled boiler door constructed in accordance with an embodiment of the present invention.

DETAILED DESCRIPTION

Figure 3:
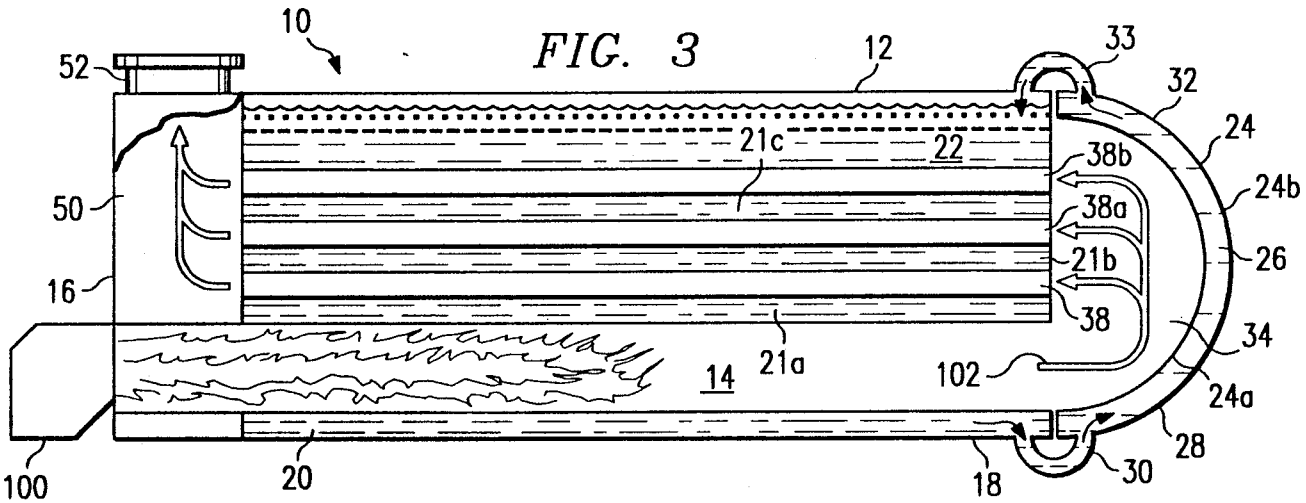
FIG. 3 is a cross-sectional view of a boiler incorporating the liquid-cooled boiler door of the present invention.

Referring to FIGS. 1 and 2, known dryback and wetback Scotch firetube boilers are illustrated. A double pass boiler having a liquid-cooled door constructed in accordance with the present invention is generally indicated at 10 in FIG. 3. Boiler 10 is generally defined by cylindrical outer wall 12. A furnace tube 14 is disposed within boiler 10 as depicted in FIG. 3 and extends from first end 16 to second 18 of boiler 10. A flooding water section 20 and a storage water section 22 are defined within boiler 10 as depicted in FIG. 3.

Tubes 38, 38*a*, 38*b* are disposed within boiler 10 as depicted in FIG. 3. Water spaces 21*a*, 21*b*, 21*c* are defined between tubes 38, 38*a*, 38*b*. As the heated gases pass through passageways 38, 38*a*, 38*b*, as discussed in detail below, there is a transfer of heat from the gases within tubes 38 to the liquid within spaces 21*a*, 21*b*, 21*c*.

Figure 4:
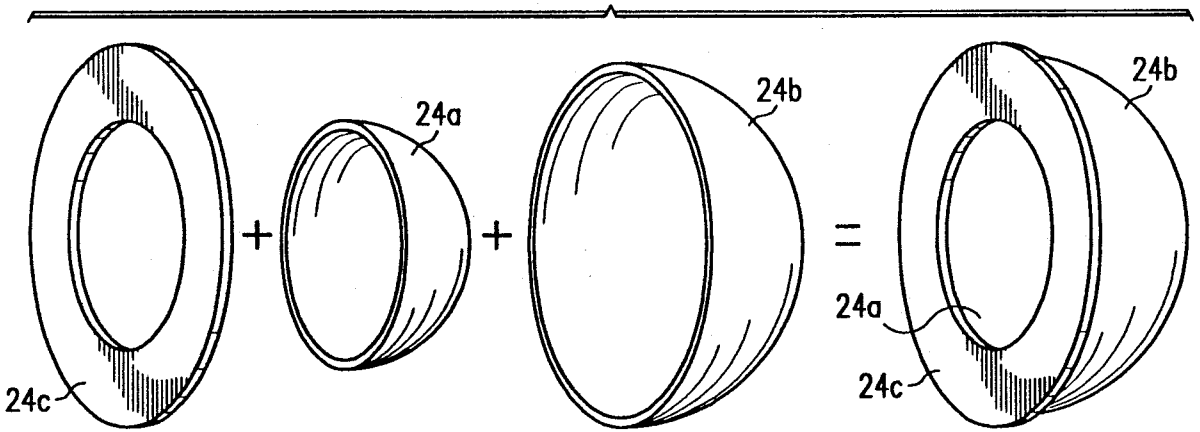
FIG. 4 is an exploded view of one embodiment of the liquid-cooled boiler door of the present invention.

A liquid-cooled door constructed in accordance with the present invention is generally indicated at 24 in FIG. 3. Door 24 includes interior wall 24*a* and exterior wall 24*b*. Circulation space 26 is defined between interior wall 24*a* and exterior wall 24*b*. In a preferred embodiment of the present invention depicted in FIG. 4, door 24 is substantially hemispherical in shape in order to provide greater structural integrity. In this embodiment, door 24 includes interior wall 24*a*, exterior wall 24*b*, and connecting wall 24*c* in order to define circulation space 26. It is to be appreciated, however, that door 24 can have any shape without departing from the scope of the present invention.

In an alternative embodiment of the present invention, door 24 has an irregular shape such as depicted in FIG. 6. In this embodiment, second end 32 of door 24 serves a dual function. First, second end 32 provides cooling of turnaround chamber 34. Second, second end 32 essentially isolates turnaround chamber 34 from the upper portions of boiler 10. The desirability of isolating turnaround chamber 34 from the upper portions of boiler 10 is discussed in detail below with respect to the inclusion of baffles 36 on interior wall 24*a*.

As depicted in FIG. 3, circulation space 26 fluidly connects flooding section 20 and storage section 22. First end 28 of circulation space 26 is fluidly connected to flooding water section 20 through first connector 30. Second end 32 of circulation space 26 is fluidly connected to storage water section 22 through second connector 33. Storage water section 22 may be used to store either water or steam. Connectors 30, 33 preferably provide a watertight connection between door 24 and the remainder of boiler 10. Connectors 30, 33 can be constructed of a flexible tubing or a plurality of pivotable elbow joints interconnected by gaskets. Other known devices can be used as connectors 30, 33 to achieve the desired effect.

Heated liquid within circulation space 26 will naturally tend to circulate due to the loss of hot liquid and steam through second connector 33. As a result, additional liquid is drawn into circulation space 26 from flooding section 20. Simultaneously, additional liquid will be drawn into flooding section 20 from the remaining sections of boiler 10. The circulation of liquid through circulation space 26 thus is achieved naturally and does not require the use of a pump. Further, this natural circulation is achieved using the flooding section and storage section of existing firetube boilers. Accordingly, the liquid-cooled door 24 of the present invention can be added to firetube boilers currently in use or can be installed as original equipment in new firetube boilers.

It will be appreciated that the flow of liquid through circulation space 26 will cool interior wall 24*a* of door 24, thus reducing the effect of erosion created by the flow of heated gases on interior wall 24*a*. In addition, it will be appreciated that the presence of liquid within circulation space 26 will provide a significant degree of insulation between the interior of boiler 10 and its external environment. Finally, liquid flowing through circulation space 26 will be heated as a result of the transfer of heat from interior wall 24*a*.

In another alternative embodiment of the present invention, door 24 is constructed of a plurality of liquid transfer tubes 135. Liquid transfer tubes 135 are preferably configured as depicted in FIG. 7. In this embodiment, outer tube 135*a* is essentially donut-shaped. Major cross tube 135*b* is in fluid communication with outer tube 135*a* and divides door 24 substantially into two halves. A plurality of tubes 135*c* fluidly connect outer tube 135*a* and major cross tube 135*b* as shown in FIG. 7. Regions 137 defined between tubes 135 are preferably constructed of a web of material that is resistant to the erosive effects of the heated gases within turnaround chamber 34. In an alternative configuration of this embodiment, tubes 135 are disposed in tangential relation to one another such that web 137 is not needed. It will be appreciated that liquid will flow from flooded water section 30, through tubes 135, and into storage water section 32 in the manner discussed in reference to other embodiments of the present invention. In this way, door 24 is cooled, thereby reducing the erosive effects of the flow of heated gases on the wall of turnaround chamber 34.

Heated gases directed through furnace tube 14 from main flame source 100 will impact interior surface of interior wall 24*a* of door 24. The stream of heated gases will be reflected by interior wall 24*a* as generally indicated by arrows 102 in FIG. 3 into tubes 38, 38*a*, 38*b*.

The boiler depicted in FIG. 3 is a double pass boiler. In a double pass boiler, heated gases passing through passageways 38, 38*a*, 38*b* enter vent chamber 50 and are subsequently removed from boiler 10 through vent 52. In some instances, it has been found to be desirable to protract the time during which the heated gases flow through boiler 10 in order to maximize the quantity of heat transferred from the gases to the liquid within boiler 10. For example, FIG. 1 depicts a three-pass dryback firetube boiler having a second turnaround chamber disposed at first end 16 of boiler 10.

In a second alternative embodiment of the present invention constructed for use with a three or four pass boilers of the type depicted in FIG. 1, door 24 includes a baffle 36 disposed along interior wall 24*a*. Baffle 36 serves to direct heated gases passing through turnaround chamber 34 into second pass 38. In other words, baffle 36 partitions turnaround space 34 into two smaller turnaround spaces 34*a*, 34*b*. In this way, heated gases entering second pass 38 do not commingle with heated gases passing into three-pass venting chamber 50*a*, thereby reducing heat loss through venting chamber 50*a*. It is to be appreciated that additional baffles 36 can be disposed along interior wall 24*a* for use with boilers having more than four passes.

Figure 5A:
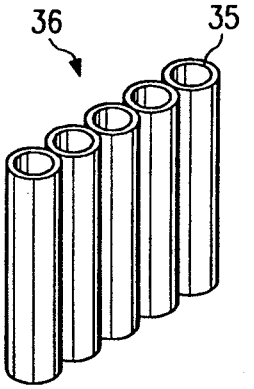
FIG. 5*a* is a detailed view of the liquid tubes of a baffle disposed on the liquid-cooled boiler door of one embodiment of the present invention.
Figure 5B:
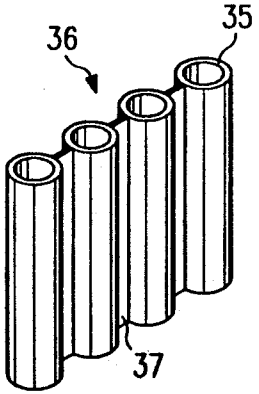
FIG. 5*b* is a detailed view of an alternative embodiment of the liquid tubes of a baffle disposed on the liquid-cooled boiler door of the present invention.

Baffle 36 is preferably constructed of a plurality of substantially parallel water tubes 35 arranged in the manner depicted in FIGS. 5*a* and 5*b*. Tubes 35 can be disposed tangentially to one another. In an alternative configuration, tubes 35 can be connected by web 37. It is to be appreciated that tubes 35 can be U-shaped or have various other configurations without departing form the scope of the present invention.

In a preferred embodiment of baffle 36 of the present invention depicted in FIG. 8, first ends 42 of tubes 40 are fluidly connected to manifold 45 and second ends 44 of tubes 40 are fluidly connected to circulation space 26 of door 24. As seen in FIG. 8, manifold 45 is mounted on internal wall 24*a* of door 24 such that the interior of manifold 45 is in fluid communication with circulation space 26. Water circulating within circulation space 26 will thus circulate within manifold 45 and water tubes 35 in order to provide cooling of baffles 36.

Although the present invention has been described in detail with reference to certain preferred embodiments, it is to be appreciated that certain modifications can be made to the disclosed liquid-cooled boiler door without departing from the true spirit and scope of the present invention.

I claim:

1. A boiler comprising:

a boiler casing defining a flooded liquid section, a storage liquid section, and a heated gas section therein;

a liquid-cooled boiler door mounted on said boiler casing adjacent said heated gas section defined by said boiler casing, said liquid-cooled boiler door having a lower portion and an upper portion, said liquid-cooled boiler door comprising:

an interior wall having a first surface and a second surface; and an exterior wall having a first surface and a second surface, said exterior wall being spaced from said interior wall whereby a circulation space is defined between said second surface of said interior wall and said first surface of said exterior wall;

a first connector having a first end and a second end, said first end of said first connector being mounted on said boiler casing proximal said flooded liquid section and said second end of said first connector being mounted on said lower portion of said liquid-cooled boiler door, said first connector fluidly connecting said flooded liquid section defined by said boiler casing to said circulation space defined between said interior wall and said exterior wall of said liquid-cooled boiler door;

a second connector having a first end and a second end, said first end of said second connector being mounted on said upper portion of said liquid-cooled boiler door and said second end of said second connector being mounted on said boiler casing proximal said storage liquid section, said second connector fluidly connecting said storage liquid section defined by said boiler casing to said circulation space defined between said interior wall and said exterior wall of said liquid-cooled boiler door;

a firetube mounted within said boiler casing proximal said flooded liquid section, said firetube having a first end and a second end, said second end of said firetube being in communication with said heated gas zone defined by said boiler casing;

a heat source connected to said first end of said firetube, said heat source having a capacity to heat gases within said firetube, whereby a liquid within said flooded liquid section defined by said boiler casing proximal said firetube is heated by said heat source, thereby thermally inducing circulation of a portion of said liquid in said flooded liquid section through said first connector, through said circulation space defined between said interior wall and said exterior wall of said liquid-cooled boiler door, and through said second connector into said storage liquid section defined by said boiler casing, and whereby said liquid-cooled boiler door is cooled by thermally induced circulation.

2. The boiler of claim 1 wherein said interior wall and said exterior wall of said liquid-cooled boiler door are hemispherically shaped, said liquid-cooled boiler door further comprising:

an annular wall having an interior edge and an exterior edge, said interior wall being mounted on said interior edge of said annular wall and said exterior wall being mounted to said exterior edge of said annular wall, whereby a circulation space is defined within said annular wall, said interior wall, and said exterior wall.

3. The boiler of claim 1 wherein said first connector and said second connector are constructed of a flexible material.

4. The boiler of claim 1 wherein said liquid-cooled boiler door further comprises:

an outer tube disposed about a periphery of said circulation space defined between said interior wall and said exterior wall, said outer tube being in fluid communication with said first connector and said second connector; and a plurality of liquid tubes disposed within said circulation space defined between said interior wall and said exterior wall, each of said plurality of liquid tubes having a first end in fluid communication with said outer tube and each of said plurality of liquid tubes having a second end in fluid communication with said outer tube.

5. The boiler of claim 4 wherein each of said plurality of liquid tubes disposed within said circulation space defined between said interior wall and said exterior wall is in tangential contact with adjacent liquid tubes.

6. The boiler of claim 4 wherein each of said plurality of liquid tubes disposed within said circulation space defined between said interior wall and said exterior wall is spaced from adjacent liquid tubes and wherein adjacent liquid tubes are connected by a web.

7. The boiler of claim 1 further comprising a baffle disposed on said first surface of said interior wall of said liquid-cooled boiler door.

8. The boiler of claim 7 wherein said baffle comprises a plurality of baffle liquid tubes, each of said plurality of baffle liquid tubes having a first end in fluid communication with said circulation space defined between said interior wall and said exterior wall of said liquid-cooled boiler door, and each of said plurality of baffle liquid tubes having a second end in fluid communication with said circulation space defined between said interior wall and said exterior wall of said liquid-cooled boiler door.

9. The boiler of claim 8 wherein each of said plurality of baffle liquid tubes is in tangential contact with adjacent baffle liquid tubes.

10. The boiler of claim 8 wherein each of said plurality of baffle liquid tubes is spaced from adjacent baffle liquid tubes and wherein adjacent baffle liquid tubes are connected by a web.

* * * * *